US005451061A

United States Patent [19]

DeLessio et al.

[11] Patent Number: 5,451,061

[45] Date of Patent: Sep. 19, 1995

[54] MULTI-PATH BOARD GAME

[76] Inventors: James DeLessio, 427 Elk St., Albany, N.Y. 12206; Anthony Tognaci, P.O. Box 1452, Clifton Park, New York, N.Y. 12065

[21] Appl. No.: 210,053

[22] Filed: Mar. 17, 1994

[51] Int. Cl.[6] ..... A63F 3/00

[52] U.S. Cl. ..... 273/243

[58] Field of Search ..... 273/242, 243, 248, 249, 273/256, 278

[56] References Cited

U.S. PATENT DOCUMENTS 2,026,082 12/1935 Darrow ..... 273/256
2,571,403 10/1951 Aird .
2,666,644 1/1954 Strehlow et al. ..... 273/256
3,565,437 2/1971 Mitchell ..... 273/256
3,977,680 8/1976 Lavine .
5,139,268 8/1992 Garnett .

*Primary Examiner*—William E. Stoll
*Attorney, Agent, or Firm*—Schmeiser, Olsen & Watts

[57] ABSTRACT

The invention is a multi-path board game in which a player's token may traverse a number of different paths. One of the paths represents the life of an honest person and another of the paths represents one who is living a life of crime. A third path represents the life of someone who is in jail. The game also makes use of three different decks of cards with each deck and its cards associated with certain occurrences that may be expected when living a particular type of life.

17 Claims, 2 Drawing Sheets

MULTI-PATH BOARD GAME

FIELD OF THE INVENTION

The invention is in the field of board games. More particularly, the invention is an educational game that employs a playing board having a plurality of separated pathways. To play the game, each player may move an associated playing piece along one or more of said pathways. A number of different decks of occurrence cards are also employed and accessed via different spaces on the pathways.

BACKGROUND OF THE INVENTION

Many prior art games attempt to simulate different aspects of life in an amusing and engaging manner. These games typically employ a game board that has a defined path upon which the player travels at a rate dependent on the movement of a spinner or the throw of dice. As play proceeds, different events occur as the players land on different areas of the board. These events can be defined by indicia located on the board or through the action of a game card that is drawn by the player. The player progresses along the pathway until he or she accumulates or loses a sum of money or reaches a particular area on the board.

A problem with some of the prior art games is that the games are usually overly dependent on chance and only slightly dependent on a player's skill or decisions. This can make the play of the game almost automatic, thereby damping a player's enthusiasm to play the game more than once. In addition, prior art games that simulate life events do not fully take into account a person's ability to choose a certain path based on risk analysis and/or decisions that are tied to one's moral aspects.

SUMMARY OF THE INVENTION

The invention is a life-simulating board game in which a player moves his or her token along any of a plurality of separate and distinct pathways. Each pathway represents a different life path and includes concomitant risks and rewards. To reach a particular goal, each player must primarily choose to follow either the path of an honest person or the path of a dishonest person.

The pathway nearest the perimeter of the game board represents the life of an honest person. This pathway includes a number of substantially straight portions with each portion consisting of a series of consecutive, delineated spaces. When traversing this pathway, if the player's token lands on certain marked spaces, the player may be rewarded. If the player's token lands on certain other marked spaces, penalties may befall the player.

Located within the polygon formed by the first pathway is a second pathway. The latter pathway is in a convoluted pattern and represents the life of a dishonest person. The second pathway is made up of a series of consecutive delineated spaces with some being blank and others marked with different indicia. When a player's token lands on the marked spaces, the player may receive a reward or a penalty dependent on the instructions provided by the indicia and sometimes further dependent on the roll of dice. Due to the life represented by this pathway, there is a significantly greater probability of the player receiving penalties than for a player whose token is traversing the first pathway.

One possible penalty that any player can suffer is to have his or her token moved to a third pathway that is located at the center of the game board. This pathway represents a jail term.

The jail term pathway is also made up of a series of consecutive spaces. As a player's token traverses this path, there is a high probability that the player's token will land on one or more marked spaces in which a penalty will be assessed on the player. When a player's token is released from "jail", the player may choose to move his or her token to either of the outer pathways.

Providing a player with a choice between paths is a central idea of the game. It is with this in mind that a player whose token is following the second pathway can "reform." This is accomplished through the use of certain of the marked spaces on the dishonest pathway which allow a player to transfer his or her token to the honest pathway.

The game also includes a random number generator such as a pair of dice or the like. The dice are used by the players in turn to determine the amount of spaces their tokens will move down their chosen pathway. In addition, the dice are sometimes used to determine whether a risk or a reward is received by a player and also at times the magnitude of the risk or reward.

The calamities and rewards received by each player are sometimes decided through the use cards picked either of three different decks of cards that are accessed via certain marked spaces on the different pathways. The three decks each represent certain types of occurrences, with one deck representing crimes, another deck representing various risks and rewards that may result from life decisions and the third deck representing the different fates that may befall a person who is in jail. Many of the cards are designed to be used in conjunction with the dice to add an element of risk and uncertainty to further increase the similarity of the game to real life.

DETAILED DESCRIPTION OF THE INVENTION

Figure 1:
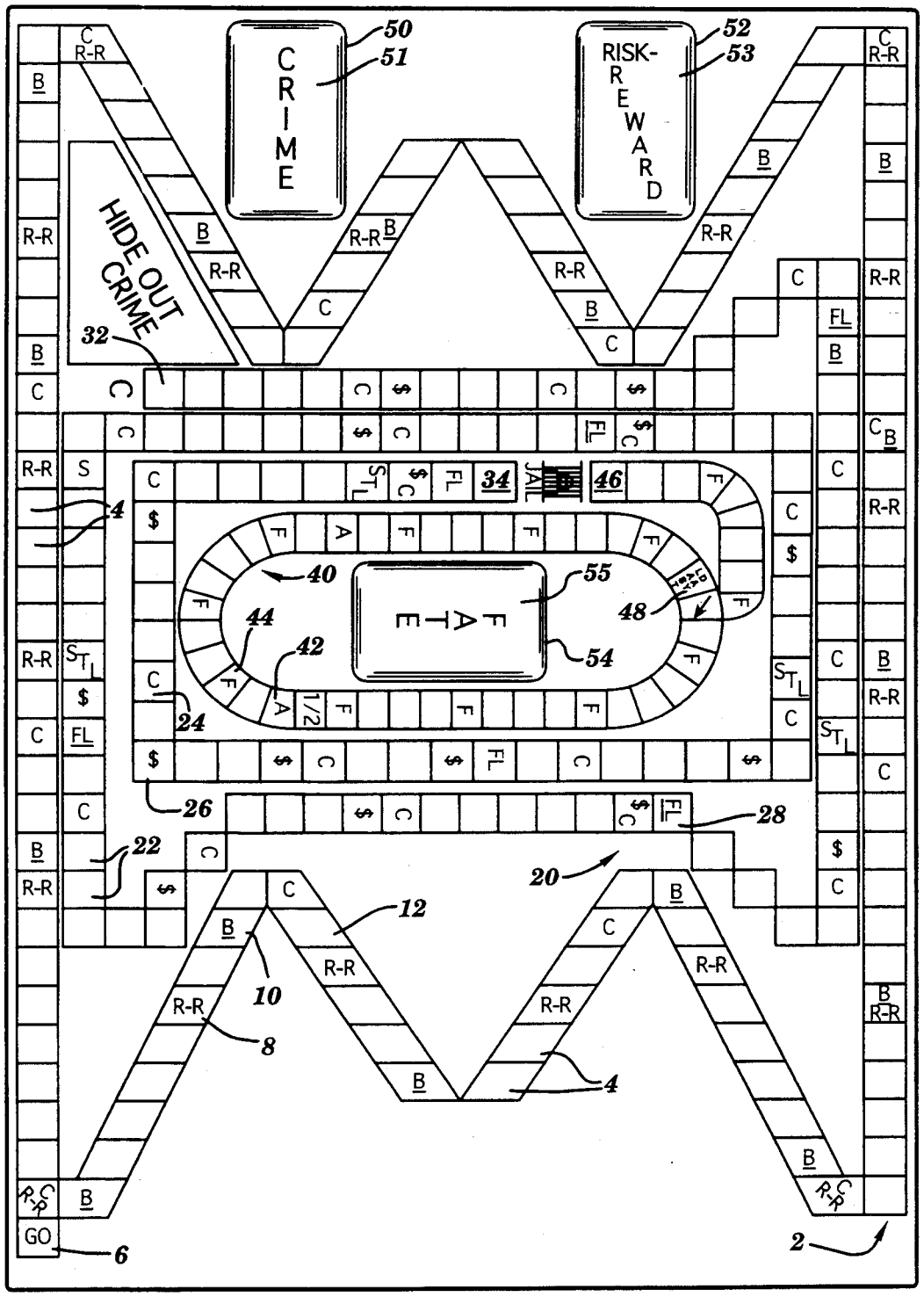
FIG. 1 is a plan view of a game board in accordance with the invention.

Referring now to the drawings in greater detail, wherein like reference characters refer to like parts throughout the several figures, there is shown by the numeral 1 a game board for use in playing a game in accordance with the invention.

The board includes an outer pathway 2 that simulates the life of a basically honest person. This pathway is comprised of a continuous series of individual spaces 4 that together form a polygon that is captured within the perimeter of the board.

The outer pathway has a start position 6 and forms a closed loop. While most of the spaces are blank, there are some spaces that include indicia that direct a player to some definite action. For example, there are spaces 8 that are marked with the letters "RR" (standing for Risk-Reward), spaces 10 marked with the letter "B" (Bonus) and spaces 12 marked with the letter "C" (Crime).

Located within the outer pathway 2 is a second pathway 20. This pathway simulates the life of a basically dishonest person. Compared to pathway 2, this pathway is much more convoluted and spirals inwardly. Pathway 20 is formed out of a series of consecutive spaces 22 that are for the most part blank. However, this path does include some marked spaces including spaces 24 that are marked with a "C" (for Crime), spaces 26 that have a "$" (standing for Payoff), spaces 28 that are marked with the letters "FL" (standing for "felony") and spaces 30 marked with the letters "STL" (standing for See The Light). It should be noted that this pathway begins at space 32 and ends at space 34.

A third pathway 40 is located proximate the center of the board. This pathway represents the life of someone who is in jail. As with the other pathways, this oval path is made up of a plurality of consecutive spaces with most blank and a few marked. Of the marked spaces, there are spaces 42 that are marked with an "A" (standing for Appeal) and spaces 44 marked with the letter "F" (standing for Fate). This path begins at space 46 and ends at space 48.

Located at different areas on the board 1 are three marked rectangles 50, 52 and 54. Onto rectangle 50 is placed the crime deck 51. The Risk-Reward deck 53 is placed onto rectangle 52 and the Fate deck 55 is placed onto rectangle 54.

Figure 2:
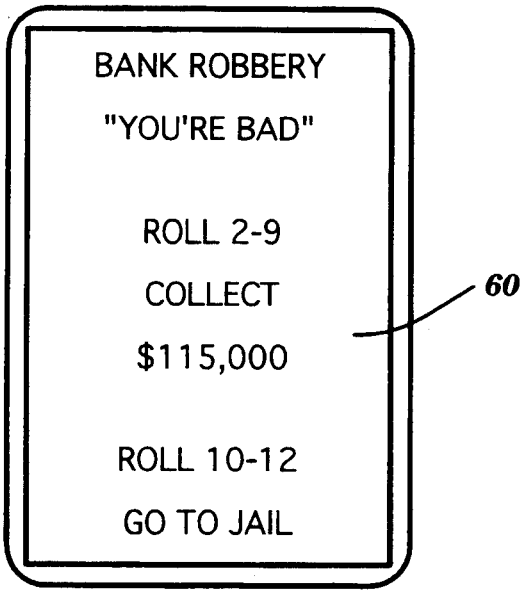
FIG. 2 is a view of one side of a typical "Crime" card used in the playing of the game.

FIG. 2 shows an example of the back face of a crime card 60. A player would pick up one of these cards whenever his or her piece lands on a space marked with the letter "C". While the figure provides one example of what might be found on a crime card 60, other examples are:

| | | |
|---|---|---|
| a.) | Drug Smuggling | roll 2–8 = collect $100,000<br>roll 9–12 = go to Jail |
| b.) | Insider Trading | roll 2–8 = collect $65,000<br>roll 9–12 = pay $65,000 |
| c.) | Eqyptian Tomb Theft | roll 2–9 = collect $150,000<br>roll 10–12 = go to Jail |

From the above, it can be seen that each crime card will list the occurrence of a crime and a possible outcome in the form of a reward or penalty determined by a roll of the dice. Each card may further include a descriptive phrase that describes a person who commits said crime. In the preferred embodiment, the crime deck 51 contains from twenty to thirty different crime cards 60 which when taken together form a crime occurrence card means.

Figure 3:
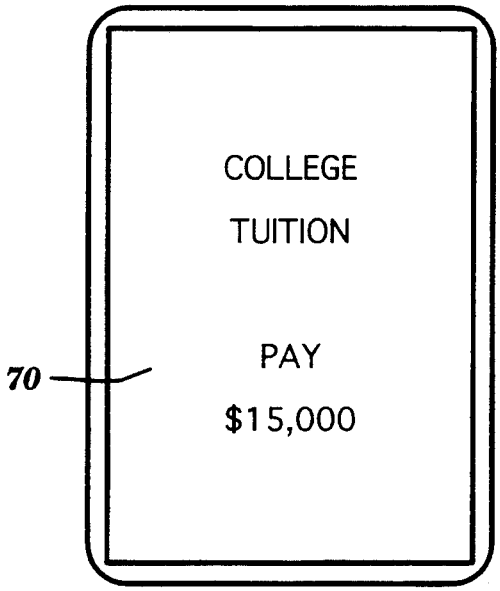
FIG. 3 is a view of one side of a typical "Risk-Reward" card used in the playing of the game.

FIG. 3 shows an example of the back face of a Risk-Reward card 70. A player would pick up one of these cards whenever his or her piece lands on a space marked with the letters "R-R". While the figure provides one example of what might be found on a Risk-Reward card, other examples are:

| | | |
|---|---|---|
| a.) | Tax Refund | collect $20,000 |
| b.) | Stock Option Available | roll 2–8 = collect $27,000<br>roll 9–12 = pay $5,000 |
| c.) | Bank error | roll 2–8 = collect $30,000 |

-continued

| | |
|---|---|
| | roll 9–12 = Go to jail |

From the above, it can be seen that each Risk-Reward card will list a possible occurrence and also an outcome that is either a penalty, a reward or a situation where the player rolls the dice to determine whether a risk or reward occurs. The Risk-Reward deck 53 forms a risk-reward card means and preferably consists of from twenty to thirty different Risk-Reward cards 70 similar in spirit to the examples provided.

Figure 4:
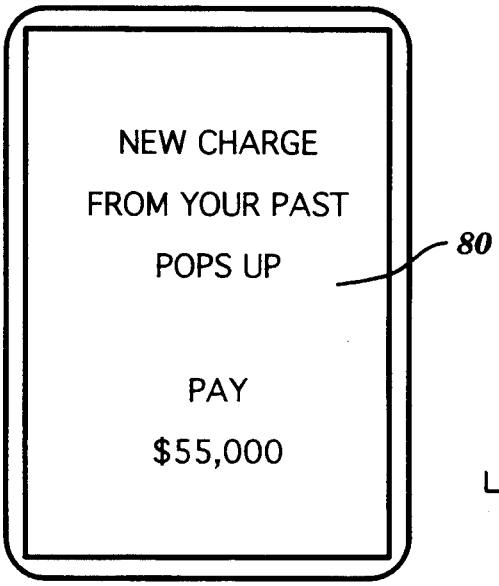
FIG. 4 is a view of one side of a typical "Fate" card used in the playing of the game.

FIG. 4 shows an example of the back face of a Fate card 80. A player would pick up one of these cards whenever his or her piece lands on a space marked with the letter "F". While the figure provides one example of what might be found on a typical Fate card, other examples are:

a.) Government claims your money was earned through crime—pay $60,000 b.) You kill another inmate defending yourself—pay $150,000 or add another jail term c.) Appeal Fails—pay $40,000

From the above, it can be seen that each Fate card describes a possible occurrence that might befall one in jail and also lists the outcome which is preferably a penalty. It should be noted that in the preferred embodiment, once in jail, there are no rewards and one cannot win the game while in jail. The fate deck 55 forms a fate occurrence card means and preferably consists of from twenty to thirty different Fate cards 80 similar in spirit to the examples provided.

Figure 5:
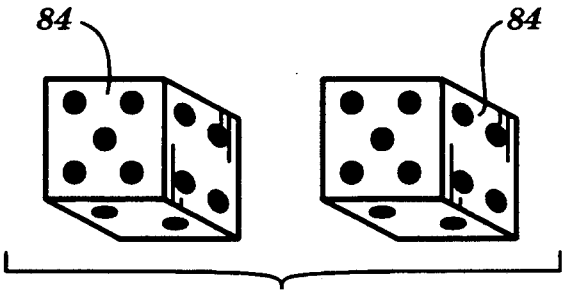
FIG. 5 is a perspective view of a pair of dice used in the playing of the game.

FIG. 5 provides a perspective view of a pair of standard dice 80. The dice function as a random number generator to determine either a player's movements or in some cases, a reward or penalty for the player. While standard dice of this sort are the preferred means for generating random numbers, other sorts of random number generators can be used including a traditional arrow-type spinner or even a display that shows a computer-generated random number.

Figure 6:
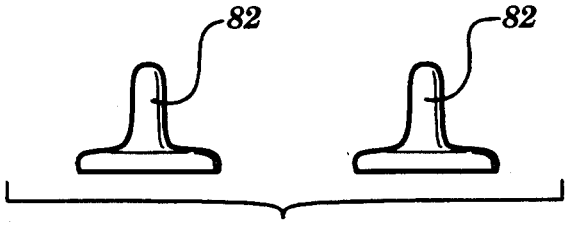
FIG. 6 is a front view of two tokens used in the playing of the game.

FIG. 6 provides two examples of a token 82 that would be used to each represent the players of the game. In the preferred embodiment, each token 82 is of a different color to therefore make each of the tokens individually distinguishable. When the game is in play, a player would move his or her token along the spaces of the particular path 2, 20 or 40 upon which it is located.

Figure 7:
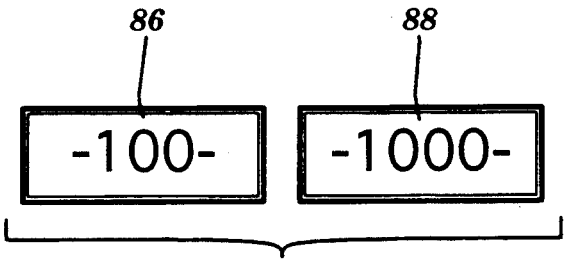
FIG. 7 is a front view of two representative examples of play money used when playing the game.

FIG. 7 provides a view of two representative examples of play money that would be used in the game. In the preferred embodiment, the game would include a "bank" of approximately five million dollars in various denominations. A $100 dollar bill 86 and a $1000 dollar bill 88 are shown. It should be noted that other forms of score keeping means can be used such as a straightforward point system.

In the preferred embodiment of playing the game, two or more people would play the game at the same time with each choosing a different token 82. The game will be won by the first player who accumulates a predetermined amount of money, such as one million dollars. At the start of the game, each player is given a predetermined amount of money such as two-hundred-thousand dollars.

Each player would start the game by placing his or her token at either space 6 or space 32. A player placing his token at space 6 would be taking the honest path. A player placing his token at space 32 would be taking the dishonest path. It should be noted that at the beginning of a game, it is up to the individual player which of the two paths to take.

The players next roll the dice 84 to determine order of play. Each consecutive player would then roll the dice and move his or her token 82 along the chosen path accordingly. A player who's token lands on a marked space having a "C" would then draw the top card from the Crime deck 51. Similarly, a player whose token lands on a space marked with an "R-R" or an "F" would draw the top card from the Risk-Reward deck 53 or Fate deck 55 respectively. The card would then instruct the player as to the result of the action/occurrence described by the card.

As an example of the above, a player's token being moved along the outer pathway 2 might land on a space marked "R-R". The associated player would then pick up the top card from deck 53 and the card might read as shown in FIG. 3. The player would then place fifteen thousand dollars of play money into the bank.

A player landing on a space marked with a "C" would pick a card from the top of the Crime deck. This signifies that the player has either committed a crime or been the victim of a crime. It should be noted that the outer path, while signifying an honest life, includes a few spaces that are marked with a "C". This portrays that even good people suffer misfortunes and/or may change and commit a crime. It should be noted that the inner pathway 20 includes far more spaces marked with a "C" then the outer pathway 2 since pathway 20 is designed to represent a life of crime.

If a player lands on a space that displays a "B", the player receives a bonus amount. The exact amount is preferably determined by rolling the dice (for example, $2000 times a roll of the dice).

The inner pathway 20 also includes a number of spaces labeled with a dollar sign ($). These spaces signify a payoff and the player whose token lands on one of these spaces would receive an amount of money from the bank. The exact amount would preferably be determined by a throw of the dice (for example, a roll of the dice times $5,000).

For a player following the inner pathway 20, a unique option occurs when his or her token lands on a space marked with the letters "STL." The player can "See The Light" and may move his or her piece to the beginning of pathway 2.

Also for the player traveling path 20, if his or her token should land on a space marked with the letters "FL", this signifies that a felony has been committed and the player would immediately move his or her piece to space 46 and begin traveling the "jail" path 40.

It should be noted that the fate cards 80 are drawn only by a player whose token is traversing the jail path. The occurrences described on each fate card are those that might befall a person who is in jail with preferably all of said occurrences being unpleasant.

When on the jail path, if a token 82 should land on a space marked with an "A", this signifies that an appeal has been made. In the preferred embodiment, the result of the appeal is determined by a throw of the dice (for example, if the player rolls a 9–12, he or she would be set free). If the player is freed, his or her token can be moved to the beginning of either path 2 or path 20.

When the player reaches the end of the jail path at space 48, the player is "set free." The player may then move his or her token 82 to the beginning space of either pathway 2 or pathway 20.

The play of the game continues until one player reaches a predetermined monetary goal or until all but on of the players but one have become bankrupt.

It should be noted that there are certain factors employed in the game that directly affect the risks and rewards associated with the different pathways 2, 20 and 40. Firstly, marked crime spaces occur much more frequently (i.e.—every few spaces) on pathway 20 then on pathway 2. Secondly, the risk-reward spaces are only found on outer pathway 2. Thirdly, while pathway 20 has a number of payoff spaces, it also has a number of felony spaces where the player's token is sent directly to jail. Fourth, there are far more bonus spaces located on pathway 2 than on pathway 20. While pathway 20 can be appealing since one can possibly receive more money in a quicker amount of time, its high risk level of the player's token being sent to "jail" compared to the outer pathway 2 will often cause a player to decide to travel said outer pathway.

It should also be noted that while the invention has been described for a board game format, the principle features of the game can be readily transferred to an electronic format/environment and played on a video game.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

We claim:

1. A multi-path board game comprising:

a game board having a first pathway and a second pathway, said first and second pathways being in the form of separate and distinct loops with each loop consisting of a plurality of contiguous delineated spaces and wherein said first pathway functions to represent the life of a person who acts honestly and said second pathway functions to represent the life of a person who acts dishonestly;

a plurality of individually distinguishable tokens wherein each token can be assigned to a different player of the game;

a score keeping means;

a random number generating means used for determining an amount of movement of said tokens along at least one of said pathways;

a crime occurrence card means that describes a plurality of different crime occurrences with each crime occurrence associated with an outcome and wherein some of said outcomes are associated with a jail means located on said game board;

a risk-reward card means that describes a plurality of different occurrences with each occurrence associated with an outcome;

a plurality of marked spaces located on said first and second pathways, a first type of said marked spaces having indicia associated with the risk-reward card means and a second type of said marked spaces having indicia associated with the crime occurrence card means and wherein said first and second types of marked spaces have different indicia that make them visually distinguishable from each other and wherein the second pathway has a greater percentage of the second type of marked spaces than does the first pathway; and wherein said jail means is capable of temporarily receiving at least one of said tokens.

2. The game of claim 1 further comprising:

a fate occurrence card means that describes a plurality of occurrences with each occurrence associated with an outcome; and wherein the jail means forms a third separate and distinct pathway on said game board upon which said tokens can travel, said third pathway consisting of a plurality of contiguous delineated spaces and including a plurality of a third type of marked spaces, said third type of marked spaces being visually distinguishable from said first and second types of marked spaces and include indicia that associate said third type of marked space with indicia located on said fate occurrence card means.

3. The game of claim 2 wherein at least one of said pathways includes at least one of a fourth distinguishable type of marked space that enables a player to increase a score total by an amount determined through the use of the random number generating means.

4. The game of claim 2 wherein the crime occurrence card means is in the form of a deck of cards with each card having indicia associated with the second type of marked space and listing a crime occurrence and an associated outcome.

5. The game of claim 4 wherein the risk-reward card means is in the form of a deck of cards with each card having indicia associated with the first type of marked space and listing an occurrence and an associated outcome.

6. The game of claim 5 wherein the fate occurrence card means is in the form of a deck of cards with each card having indicia associated with the third type of marked space and listing an occurrence and an associated outcome.

7. The game of claim 1 further comprising at least one marked space located on said second pathway that includes indicia that is different from the indicia of the first and second types of marked spaces and functions to indicate to the player that a token landing on said space can be transferred to a space located on the first pathway.

8. The game of claim 1 wherein the score keeping means is in the form of a quantity of play money that is at least partially divided between the players of the game and wherein the portion of the play money assigned to a player is increased or decreased through the play of the game.

9. The game of claim 1 wherein the second pathway has a plurality of a third type of marked space that is distinguishable from the first and second types of marked spaces and wherein said third type of marked space functions to represent the committing of a felony and has indicia associated with the jail means 10. The game of claim 1 wherein the jail means is in the form of a loop of contiguous delineated spaces and wherein an end one of said spaces is separated by a predetermined distance from said first and second pathways wherein when a player's token has traversed every space of the jail means, the token may then be moved to a space located on either of the first or second pathways.

11. The game of claim 1 wherein the random number generating means is also used for determining whether an outcome associated with an occurrence from either of said risk-reward card means or said crime occurrence card means will provide a benefit to a player.

12. A multi-path board game comprising:

a plurality of tokens, each of said tokens being individually distinguishable and capable of representing a player of the game;

a game board having first and second pathways thereon, said pathways being separated from each other and wherein each pathway is formed from a plurality of consecutive delineated spaces, said pathways defining a route for said tokens to follow and wherein said spaces are each sized to contain at least one of said tokens;

a random number generating means for advancing the tokens along either of said pathways;

a first card deck having a plurality of cards, each of said cards describing a crime and also listing an associated reward or penalty and wherein a plurality of a first type of marked spaces are located on at least one of said pathways, said first type of marked spaces having indicia that are associated with indicia located on each card of said first card deck and function to designate that a player of the game should take one of said cards from said first card deck when a player's token lands on said first type of marked space;

a second card deck having a plurality of cards, each of said cards describing a certain occurrence and an associated outcome consisting of a reward or a penalty and wherein a plurality of a second type of marked spaces are located on at least one of said pathways, said second type of marked spaces having indicia that are associated with indicia located on each card of said second card deck and function to designate that a player of the game should take one of said cards from said second deck when a player's token lands on said second type of marked space;

a quantity of play money that can be provided to the players of the game; and wherein said second pathway includes a plurality of a third type of marked spaces that have indicia indicating that when a player's token lands on one of said third type of marked spaces, the player then has the option of transferring the token associated with said player to a space located on the first pathway.

13. The game of claim 12 further including a third pathway located on said game board and spaced apart from said first and second pathways, said third pathway functioning to represent a jail term and consisting of a plurality of consecutive delineated spaces that form a loop that has a first space having indicia that functions to represent a beginning point of the loop and a second space that has indicia that functions to represent an ending point on the loop and wherein when a player's token has been moved to said ending point, the token may then be moved to a space on either of said first or second pathways.

14. The game of claim 13 further comprising a third card deck having a plurality of cards, each card describing an occurrence that may befall a person who is in jail and also an associated outcome for the player and wherein a fourth type of marked spaces are located on said third pathway and include indicia that are associated with indicia located on each card of the third card deck and function to designate that a player whose token lands on said fourth type of marked space should draw a card from said third card deck.

15. The game of claim 13 wherein a first ratio defined by the number of the first type of marked spaces on the first pathway divided by the total number of spaces on the first pathway is less than a second ratio defined by the number of the first type of marked spaces on the second pathway divided by the total number of spaces on the second pathway.

16. A multi-path game comprising:

a surface having a first looped pathway and a second looped pathway, said first and second pathways being separate and distinct from each other and each comprising a plurality of contiguous delineated spaces;

a plurality of individually distinguishable tokens wherein each token can be assigned to a different player of the game;

a score keeping means;

a random number generating means used for determining an amount of movement of said tokens along at least one of said pathways;

a crime occurrence card means that describes a plurality of different crime occurrences and an outcome associated with each occurrence and at least one of said outcomes is in the form of indicia specifically associated with a jail means that is also located on said surface;

a plurality of uniquely distinguishable areas on said first and second pathways, said areas having indicia that are associated with the crime occurrence card means and function to indicate that when a player's token lands on one of said uniquely distinguishable areas, said player should receive an occurrence from the crime occurrence card means; and wherein the first pathway has a total number of spaces of which a first percentage of said spaces include said uniquely distinguishable marked areas and wherein the second pathway has a total number of spaces of which a second percentage of said spaces include said uniquely distinguishable marked areas and wherein the second percentage is greater than the first percentage whereby the first pathway functions to designate the life of an honest person since it provides relatively fewer chances for a player's token to land on a space that functions to cause a player to receive an occurrence from the crime occurrence card means.

17. A method of playing a multi-path board game comprising:

moving one of a plurality of individually distinguishable tokens along a game board having a first pathway and a second pathway, said first and second pathways being in the form of separate and distinct loops with each loop consisting of a plurality of contiguous delineated spaces and wherein said first pathway functions to represent the life of a person who acts honestly and said second pathway functions to represent the life of a person who acts dishonestly;

keeping score using a score keeping means;

using a random number generating means for determining an amount of movement of each of said tokens along at least one of said pathways;

receiving an occurrence notice from a crime occurrence card means when one of said tokens lands on a first type of marked space, said crime occurrence card means having a plurality of different occurrence notices with each associated with an outcome and wherein at least one of said outcomes requires placing said token in a jail means located on said game board; and wherein the second pathway has a greater percentage of the first type of marked spaces than does the first pathway.

* * * * *